US011383287B2

(12) United States Patent
Rukat

(10) Patent No.: US 11,383,287 B2
(45) Date of Patent: Jul. 12, 2022

(54) CAN BASE FORMING

(71) Applicant: Crown Packaging Technology, Inc., Alsip, IL (US)

(72) Inventor: Bronislaw Rukat, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 16/607,208

(22) PCT Filed: Feb. 16, 2018

(86) PCT No.: PCT/GB2018/050412
§ 371 (c)(1),
(2) Date: Oct. 22, 2019

(87) PCT Pub. No.: WO2018/197827
PCT Pub. Date: Nov. 1, 2018

(65) Prior Publication Data

US 2020/0376535 A1 Dec. 3, 2020

(30) Foreign Application Priority Data

Apr. 25, 2017 (GB) ..... 1706554

(51) Int. Cl.
*B21D 22/28* (2006.01)
*B21D 51/26* (2006.01)

(52) U.S. Cl.
CPC ..... *B21D 22/28* (2013.01); *B21D 51/26* (2013.01)

(58) Field of Classification Search
CPC ..... B21D 22/28; B21D 22/283; B21D 22/30; B21D 51/26
USPC ..... 413/69, 76; 72/348
See application file for complete search history.

(56) References Cited

U.S. PATENT DOCUMENTS

| | | | | |
|---|---|---|---|---|
| 3,771,345 | A * | 11/1973 | Paramonoff | B21D 22/30 72/349 |
| 4,578,981 | A * | 4/1986 | Nishikawa | B21D 22/28 72/347 |
| 5,797,292 | A | 8/1998 | Johansson et al. | |
| 6,351,980 | B1 * | 3/2002 | Jowitt | B21D 22/30 72/348 |
| 6,351,981 | B1 * | 3/2002 | Jowitt | B21D 22/30 72/348 |
| 9,550,222 | B2 * | 1/2017 | Butcher | B21D 22/22 72/349 |
| 2006/0225479 | A1 * | 10/2006 | Zauhar | B21D 51/26 72/348 |

(Continued)

FOREIGN PATENT DOCUMENTS

| | | | | |
|---|---|---|---|---|
| WO | WO 99/14000 | A1 | 3/1999 | |
| WO | WO-9914000 | A1 * | 3/1999 | B21D 22/30 |

(Continued)

*Primary Examiner* — Debra M Sullivan
*Assistant Examiner* — Matthew Stephens
(74) *Attorney, Agent, or Firm* — Condo Roccia Koptiw LLP

(57) ABSTRACT

An apparatus for forming a base profile on a metal container carried on a punch moving along an axis. The apparatus comprises a die for forming the base profile on the container and a resilient support for holding the die in a resting position substantially along said axis whilst allowing the die to be deflectable perpendicular to said axis and providing a restoring force to return the die to the resting position.

11 Claims, 9 Drawing Sheets

(56) References Cited

U.S. PATENT DOCUMENTS

| | | | | |
|---|---|---|---|---|
| 2008/0028818 | A1 | 2/2008 | Zauhar | |
| 2017/0291209 | A1* | 10/2017 | Zauhar | B21D 51/26 72/349 |
| 2017/0361971 | A1* | 12/2017 | Jentzsch | B21D 51/2684 72/349 |
| 2018/0207706 | A1* | 7/2018 | Swedberg | B21D 22/283 72/349 |

FOREIGN PATENT DOCUMENTS

| | | | |
|---|---|---|---|
| WO | WO 2006/084042 | A2 | 8/2006 |
| WO | 2017040780 | A1 | 3/2017 |

* cited by examiner

CAN BASE FORMING

CROSS-REFERENCE TO RELATED APPLICATIONS

This application is the National Stage of International Application No. PCT/GB2018/050412 filed Feb. 16, 2018, which claims the benefit of GB application number 1706554.1, filed Apr. 25, 2017, the disclosures of which are incorporated herein by reference in their entirety.

FIELD OF THE INVENTION

The present invention relates to an apparatus for forming a base profile on a container and, in particular, though not necessarily, to a dome station or a can bodymaker comprising such an apparatus. The invention also relates to a method of forming a base profile on a container. The invention further relates to an adjustment mechanism for a can bodymaker and a method of adjusting the position of a component in a can bodymaker.

BACKGROUND

In known bodymakers for the production of thin-walled metal cans by the so-called "drawing and wall-ironing" (DWI) process, cups are fed to the bodymaker and carried by a punch, on the end of a reciprocating ram, through a series of dies to obtain the desired size and thickness of the can. The series of dies may include a redraw die for reducing the diameter of the cup and lengthening its sidewall, and one or more ironing dies for wall-ironing a cup into a can body. Ultimately, the can body carried on the punch contacts a bottom forming tool or 'dome station' so as to form a shape such as a dome on the base of the can.

When the punch carries the can body into contact with the dome station, any misalignment can lead to the can body end splitting, particularly where the can body is aluminium. For example, the misalignment may causes 'pinching' in one local area of the can base, which leads to defects such as 'smile marks' (cosmetic damage), 'local thinning' (which weakens the can base) or 'split domes'—all of which are unacceptable quality issues. Damage to the can base may not be immediately visible to the naked eye and may lead to the can bursting once the can body has been filled. Problems may not occur until after the filled can has been purchased by a consumer.

To ensure that the can base is formed correctly, it is important to accurately align the dome station with the punch, which is a task that requires skill and patience. Accurate alignment is also needed to ensure that the machines can be operated safely and efficiently. The perfect alignment for assuring optimum can quality may not only be difficult to achieve but also difficult to maintain during large batch runs. For example, if the dome station is aligned to the punch 'statically' (i.e. when the machine is not running) then it may be found to be misaligned when the bodymaker is running due to the dynamic effects of the mechanism altering the punch alignment. Varying temperatures can also have a similar effect.

Alignment and re-alignment of known bodymakers is a time consuming process which requires the can body production line to be halted. The high volume nature of the can industry means that any lost production time can be very costly for producers.

A known method for aligning a dome station involves moving a housing containing the bottom forming tooling within the body of the dome station. The housing is mounted using four screws which are equally spaced around the outside of the housing, pointing towards its centre and inclined at 45 degrees from a horizontal bed on which the dome station is supported. Each screw must be adjusted in turn in order to adjust the vertical or horizontal position of the housing.

WO99/14000 describes a dome station for forming a dome on the base of a beverage can.

SUMMARY

According to a first aspect of the present invention there is provided an apparatus for forming a base profile on a metal container carried on a punch moving along an axis. The apparatus comprises a die for forming the base profile on the container and a resilient support for holding the die in a resting position substantially along said axis whilst allowing the die to be deflectable perpendicular to said axis and providing a restoring force to return the die to the resting position.

The die may be deflectable perpendicular to said axis by more than 100 μm and preferably by more than 500 μm.

The apparatus may comprise a hold down ring surrounding the die and slidable thereon against a restoring force to contact a container base ahead of the die, the hold down ring being deflectable in conjunction with the die perpendicular to said axis.

The apparatus may comprise one or more sensors for measuring deflection of the die and/or the hold down ring perpendicular to said axis. The sensors may be eddy current sensors. The apparatus may comprise a housing surrounding the die and deflectable in conjunction with the die perpendicular to said axis. The eddy current sensor(s) may be configured to measure deflection of the housing perpendicular to said axis. The eddy current sensors may comprise four eddy current sensors in a substantially equiangular arrangement with respect to the axis.

The apparatus may be used in a can bodymaker.

According to a further aspect of the invention there is provided a method for forming a base profile on a metal container. The method comprises locating a container on a punch, using the punch to drive the container base, in an axial direction, against a die defining said base profile. The die is deflectable upon impact of the container base against the die or against a component coupled to the die, perpendicular to the axial direction against a restoring force. The component may be a hold down ring.

The method may comprise measuring the deflection of the die in the perpendicular direction by the punch.

According to a further aspect of the invention there is provided an adjustment mechanism for adjusting the position of a component of a can bodymaker in a plane substantially perpendicular to a centreline along which a punch travels. The adjustment mechanism comprises first and second translation mechanisms for translating the component within the plane along respective, mutually orthogonal axes. Each translation mechanism comprises: a cylindrical gear rotatable about the centreline; and first and second linear actuators having respective supports for supporting the component therebetween. The actuators are meshed with the gear at substantially diametrically opposed locations, such that rotation of the gear moves the supports in substantially the same direction and by substantially the same distance in order to effect translation of the component along the corresponding axis.

The adjustment mechanism may comprise a locking mechanism for releasably locking the component in position. The locking mechanism comprises a locking plate and a retaining plate arranged substantially parallel to one another and being in mutual contact via respective opposing faces, the retaining plate being for holding the locking plate in compression against the component. One of the plates is rotatable against and relative to the other plate to allow raised regions on the opposing faces to be brought into and out of rotational alignment in order selectively force the locking plate away from the retaining plate and against the component. One or more of the raised regions may be provided by a spring.

According to a further aspect of the invention there is provided an apparatus for forming a base profile on a metal container carried on a punch moving along an axis. The apparatus comprises: a die for forming the base profile on the container; a hold down ring surrounding the die and slidable thereon against a restoring force along said axis to contact a container base ahead of the die; and a resilient support for holding the hold down ring in a resting position surrounding the die whilst allowing the hold down ring to be deflectable perpendicular to said axis and providing a restoring force along perpendicular to said axis to return the hold down ring to the resting position.

The hold down ring may be deflectable perpendicular to said axis by more than 100 μm and preferably by more than 500 μm.

The die may not be moveable by the punch.

The apparatus may comprise one or more sensors for measuring deflection of the hold down ring perpendicular to said axis. The one or more sensors may be eddy current sensors.

The apparatus may comprise a housing surrounding the hold down ring and deflectable in conjunction with the hold down ring perpendicular to said axis, the eddy current sensor(s) being configured to measure deflection of the housing perpendicular to said axis. The eddy current sensors may comprise four eddy current sensors in a substantially equiangular arrangement with respect to the axis.

The apparatus may be used in a can bodymaker.

According to a further aspect of the invention there is provided a method for forming a base profile on a metal container. The method comprises locating a container on a punch, using the punch to drive the container base, in an axial direction, against a hold down ring surrounding a die defining said base profile, the hold down ring being slidable on the die against a restoring force along said axis to contact the container base ahead of the die. The hold down ring is deflectable upon impact of the container base against the hold down ring, perpendicular to said axial direction against a restoring force perpendicular to said axial direction.

The method may comprise measuring the deflection of the hold down ring perpendicular to said axis by the punch.

DETAILED DESCRIPTION

Figure 1:
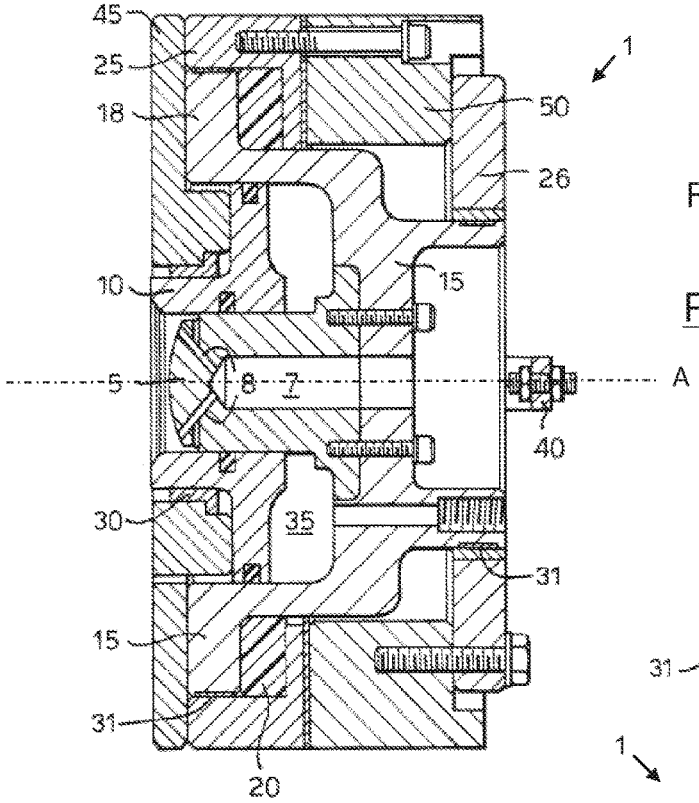
Figure 1 PRIOR ART
FIG. 1 is a schematic cross-sectional side view of a known dome station.
Figure 2:
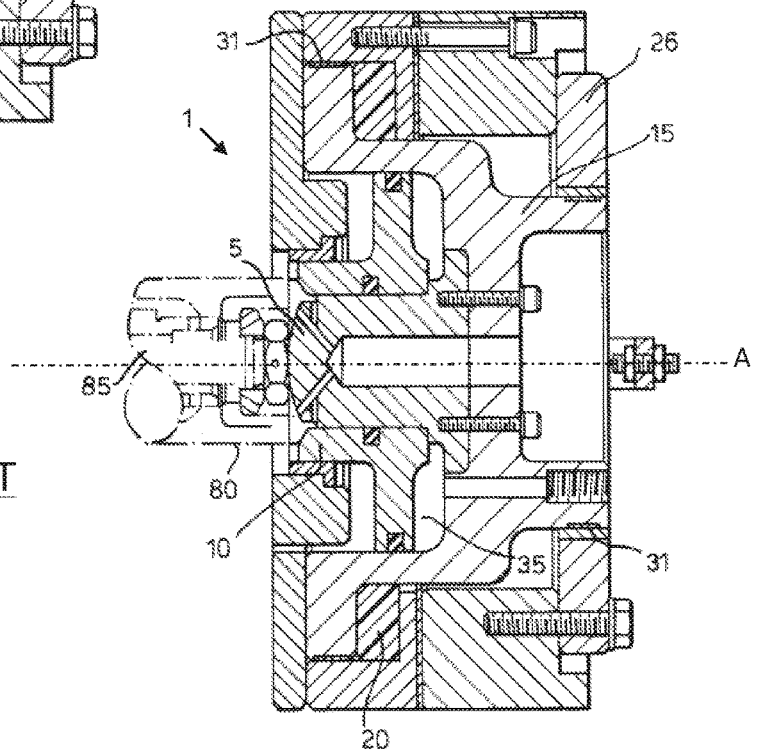
Figure 2 PRIOR ART
FIG. 2 is a schematic cross-sectional side view of the known dome station of FIG. 1 in contact with a can carried on a punch.

FIG. 1 is a schematic cross-sectional view of a known dome station 1 for a can bodymaker, with the broken line A indicating the axis of alignment and along which a can travels during production (travelling first from left to right and then in the reverse direction). The dome station 1 comprises: a dome-shaped die 5; a hold down ring 10; a 'top hat' shaped dome die support 15; a polyurethane ring 20; an outer ring 25; bearings 30, 31; a front plate 45 and a back plate 26; and a housing 50. FIG. 2 shows the dome station 1 after a punch 85 carrying a can 80 has been driven into dome station 1 from the left hand side.

The die support 15 is mounted in the housing 50 using the outer ring 25. The die support 15 has an outwardly projecting flange 18 which fits closely within the outer ring 25, but which is able to slide within the outer ring 25 when the die support 15 receives the impact of the punch 85. The polyurethane ring 20 is installed around the die support 15 to act as a shock absorber between the flange 18 and the housing 50. The front plate 45 is bolted to the punch-facing face of the housing 50 to ensure the die support 15 remains within the outer ring 25. The back plate 26 is bolted to the other face of the housing 50. The alignment of the die support 15 with respect to the punch 85 is maintained by the bearing 31 mounted in back plate 26.

The die 5 is bolted rigidly inside the die support 15 so that when the die 5 is struck by the punch 85, the force of the impact is transmitted to the die support 15. The hold down ring 10 surrounds the die 5 and has a can-receiving end and a flanged end which closes off an annular chamber 35 within the die support 15. The can-receiving end is supported within the bearing 30 mounted in the front plate 45. The flanged end of the hold down ring 10 is positioned against the front plate 45, so that the hold down ring 10 extends proud of the die 5. This arrangement ensures that, during the forward stroke of the punch 85, the can 80 strikes the ring 10 before coming into contact with the die 5. The hold down ring 10 is then driven by the punch 85 along the die 5 into the annular chamber 35 as a piston within the die support 15. Compression of the air sealed within the annular space 35 provides a braking force to the hold down ring 10 which clamps the can 80 between the punch 85 and hold down ring 10. The punch 85 forces the base of the can 80 over the domed surface of the die 5 to form the base profile on the can. When the punch is subsequently retracted from the dome station 1, re-expansion of the compressed air forces the hold down ring 10 back along the die 5 to restore its original position against the front plate 45.

A limitation of the known dome station described above is that it requires very precise alignment of the punch to ensure that high-quality cans are produced. Misalignments between the centreline of the die and the punch of as little as 250-500 μm may be sufficient to cause defects, for example. It is therefore desirable to reduce the sensitivity of the dome station to misalignments and to provide a mechanism or method by which the dome station may be aligned easily.

Figure 3:
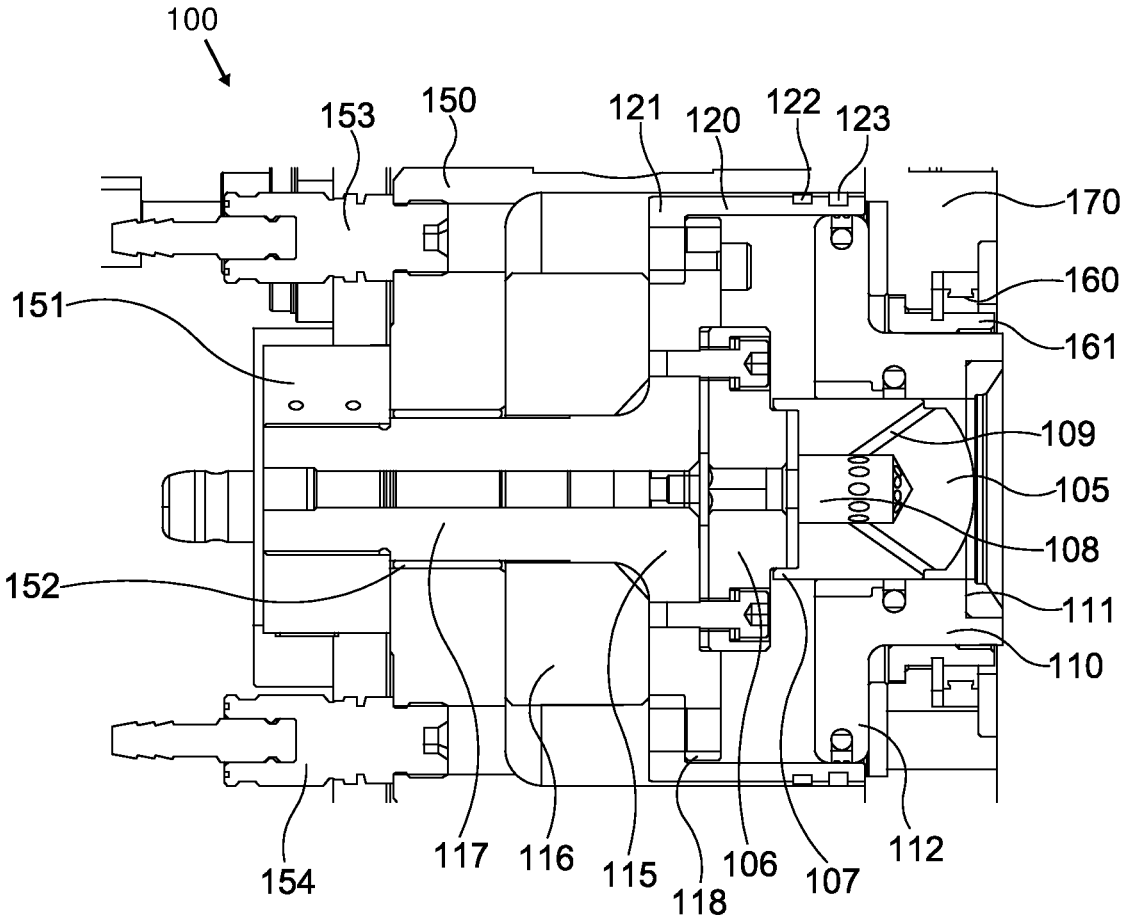
FIG. 3 is a schematic cross-sectional side view of part of a dome station according to an embodiment of the invention.

FIG. 3 shows a schematic cross-sectional side view of an exemplary improved dome station 100 for a can bodymaker. In this Figure, the dome station 100 is oriented to receive a punch (not shown) from the right hand side (the orientation is reversed as compared with FIGS. 1 and 2). The dome station 100 comprises a dome die 105, an adapter flange 106, a hold down ring 110, a die support 115, a shock absorber ring 116, a floating cylinder 120, a housing 150, a locking ring 151, a damper ring 160, and a front plate 170.

The dome die 105 has a cylindrical body with an outwardly curved (domed) front face and a flat rear face with a lip 107 formed around its circumference. A 'bullet' shaped outlet channel 108 extends through the rear end along the axis of the body before tapering to a point before the front face. A series of connecting channels 109 join the outlet channel 108 with the space surrounding the front face of the die. After a can body (not shown) is pressed on to the die 105 by the punch, compressed air forced through the channels 109 forces the base of the can body from the die 105. The rear face of the die 105 is bolted to the adapter flange 106, with the lip 107 being mated with a protruding portion of the flange 106 to ensure the die 105 remains centred.

The die support 115 comprises a hollow cylindrical stem 117 with a flange 118 at one end to which the adapter flange 106 is bolted. The housing 150 comprises a hollow cylindrical body which is closed at one end by a rear wall and with an outwardly projecting flange at the other, open, end (see FIG. 4). The stem 117 of the die support 115 passes through a bearing 152 located in the rear wall and into the locking ring 151. The stem 117 is able to move within the bearing 152 when the punch strikes the die 105 and the shock absorber ring 116 is located between the flange 118 of the die support 115 and the rear wall in order to dampen the impact. The locking ring 151 is secured to the die support 115 to prevent the die support 115 from rebounding too far into the housing 150 when the punch is retracted.

The floating cylinder 120 fits around the flange 118 of the die support 115 and has a rear wall 121 to which the flange 118 is bolted, so that the die support 115 and the floating cylinder 120 are constrained to move as a single object. The floating cylinder 120 is slightly smaller than the interior space of the housing 150 to allow the floating cylinder a small amount of radial movement during a punch strike. A guide ring 122 and a piston seal 123 are fitted around and partially recessed into the outer surface of the body of the floating cylinder 120. The guide ring 122 prevents the cylinder from contacting the housing 150, while the piston seal 123 prevents pressurised gas within the housing 150 from escaping around the cylinder 120.

The hold down ring 110 surrounds the die 105 and has a recessed flat face 111 for receiving the can (not shown) on the end of the punch. Despite being a close fit for the die 105, the hold down ring 110 is able to slide back and forth along the die 105. The rear end of the hold down ring 110 has a flange 112 which forms a piston within the floating cylinder 120 to generate a braking force which clamps the can against the punch during forming of the base profile. To increase the braking force, the interior spaces of the housing 150 and floating cylinder 121 may be pressurised with gas supplied through a pair of inlets 153, 154 located in the rear wall of the housing 150. The flange 112 is retained within the housing 151 by the front plate 170, which is bolted over the flanged end of the housing 151. The front end of the hold down ring 110 is supported within the front plate 170 by the damper ring 160, which is formed of a resilient material (e.g. a plastics material such as polyurethane) which may be compressed to allow radial movement of the hold down ring 110 with respect to the front plate 170 and the punch. Following a punch strike, re-expansion of the damper ring 160 restores the hold down ring 110 to its more central resting position. A bearing 161 may be installed between the hold down ring 110 and the damper ring 160 in order to allow reciprocation of the hold down ring 110 within the floating cylinder 120 without unseating or damaging the damper ring 160.

The improved dome station 100 requires less precise alignment with respect to the punch because the die 105 and the hold down ring 110 are able to move radially within the housing 150 by a small amount in response to the impact of the punch. In general, any radial misalignment between the punch and the die 105/hold down ring 110 will produce an unbalanced radial force during forming of the base profile of the can. This unbalanced force acts to displace the die 105 and the hold down ring 110 into improved alignment with the punch, thereby preventing or reducing damage to the base of the can as it is being formed. Wear or damage to the components of the dome station may also be reduced as a consequence of the improved cooperation between the punch and the die 105/hold down ring 110. Note that, as the hold down ring 110 fits closely around the die 105 and closely within the floating cylinder 120, the radial alignment between the hold down ring 110 and the die 105 is maintained throughout the punch strike.

Alternatively, the die 105 may be fixed in position relative to the can bodymaker whilst the hold down ring 110 is able to move radially within the housing 150 by a small amount in response to the impact of the punch. In this case, the hold down ring 110 does not fit closely around the die 105, i.e. there is a small gap between the inside of the hold down ring 110 and the die 105. The hold down ring 110 is supported by a resilient support which provides a radial restoring force to the hold down ring 110 when the hold down ring 110 is deflected from its resting position surrounding the die 105. When a misaligned punch strikes the hold down ring 110, the hold down ring 110 and the punch remain in contact so that the radial restoring force acting on the hold down ring 110 guides both the hold down ring 110 and the punch towards the die, thereby improving the radial alignment during forming of the base profile. In a further embodiment the die 105 and the hold down ring are independently deflectable by the punch, relative to the housing 150.

Figure 4:
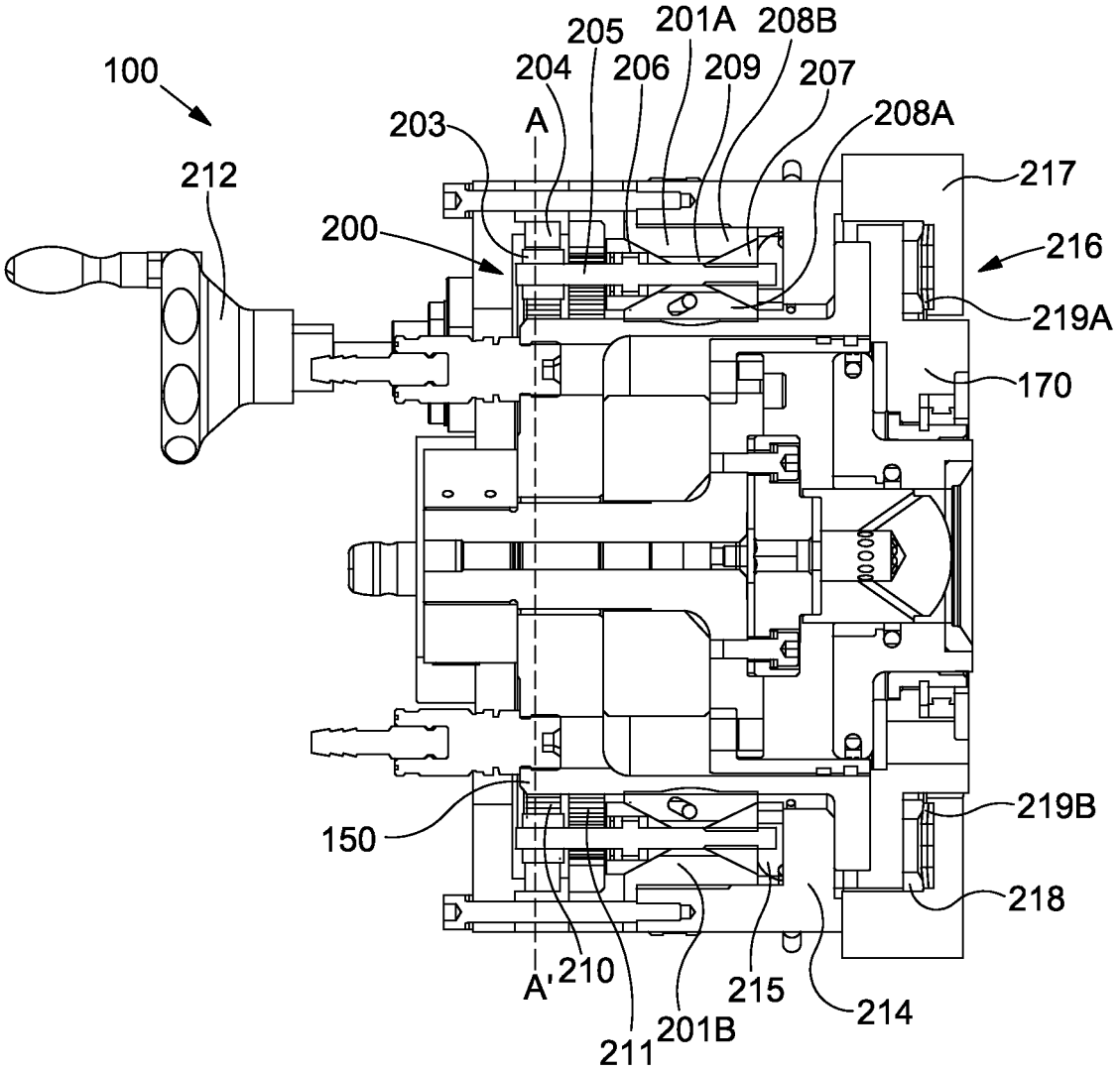
FIG. 4 is a further schematic cross-sectional side view of the dome station of FIG. 3.
Figure 5:
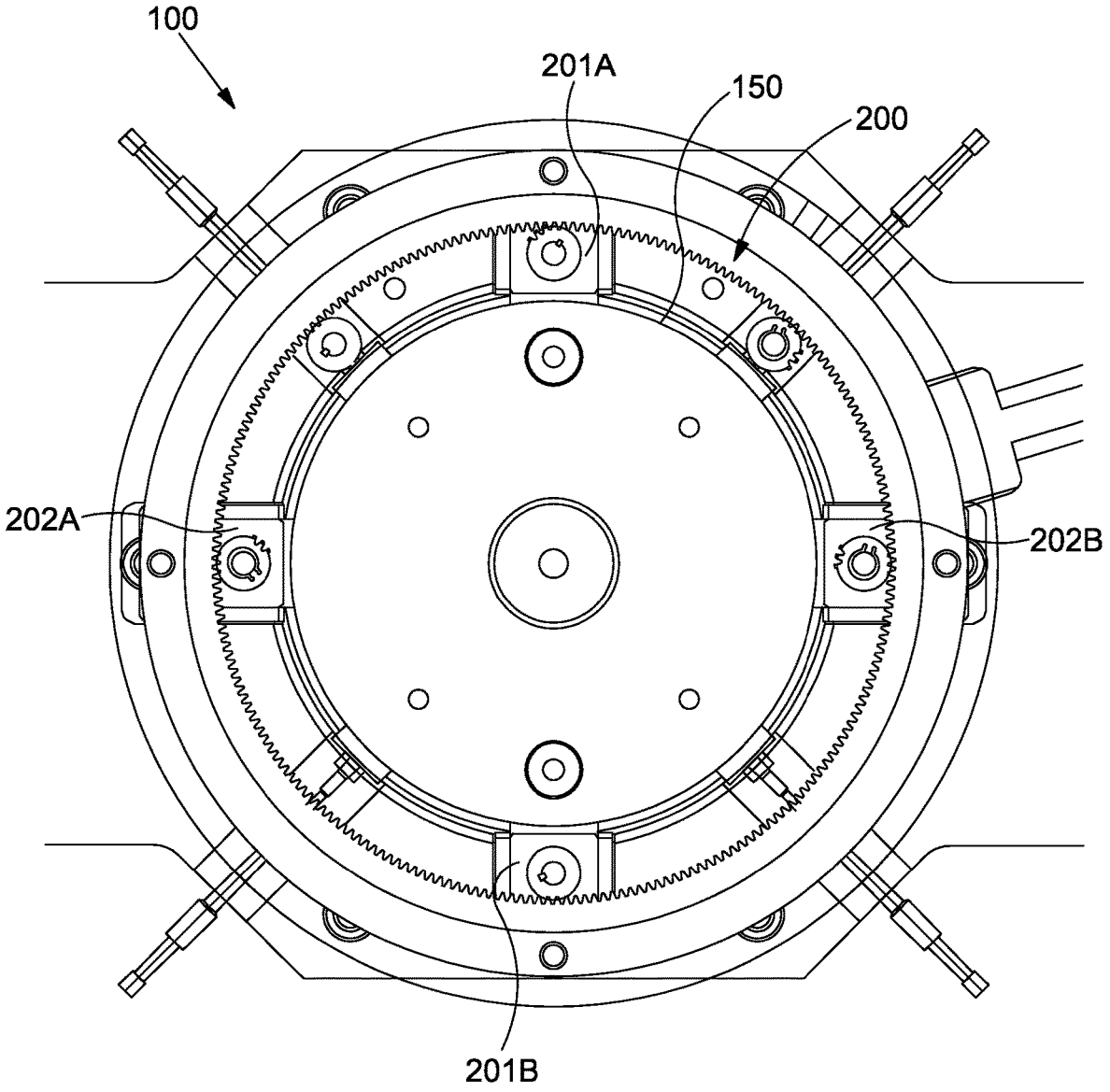
FIG. 5 is a schematic cross-sectional face view of the dome station of FIG. 3 taken along the line A-A' shown in FIG. 4.
Figure 6:
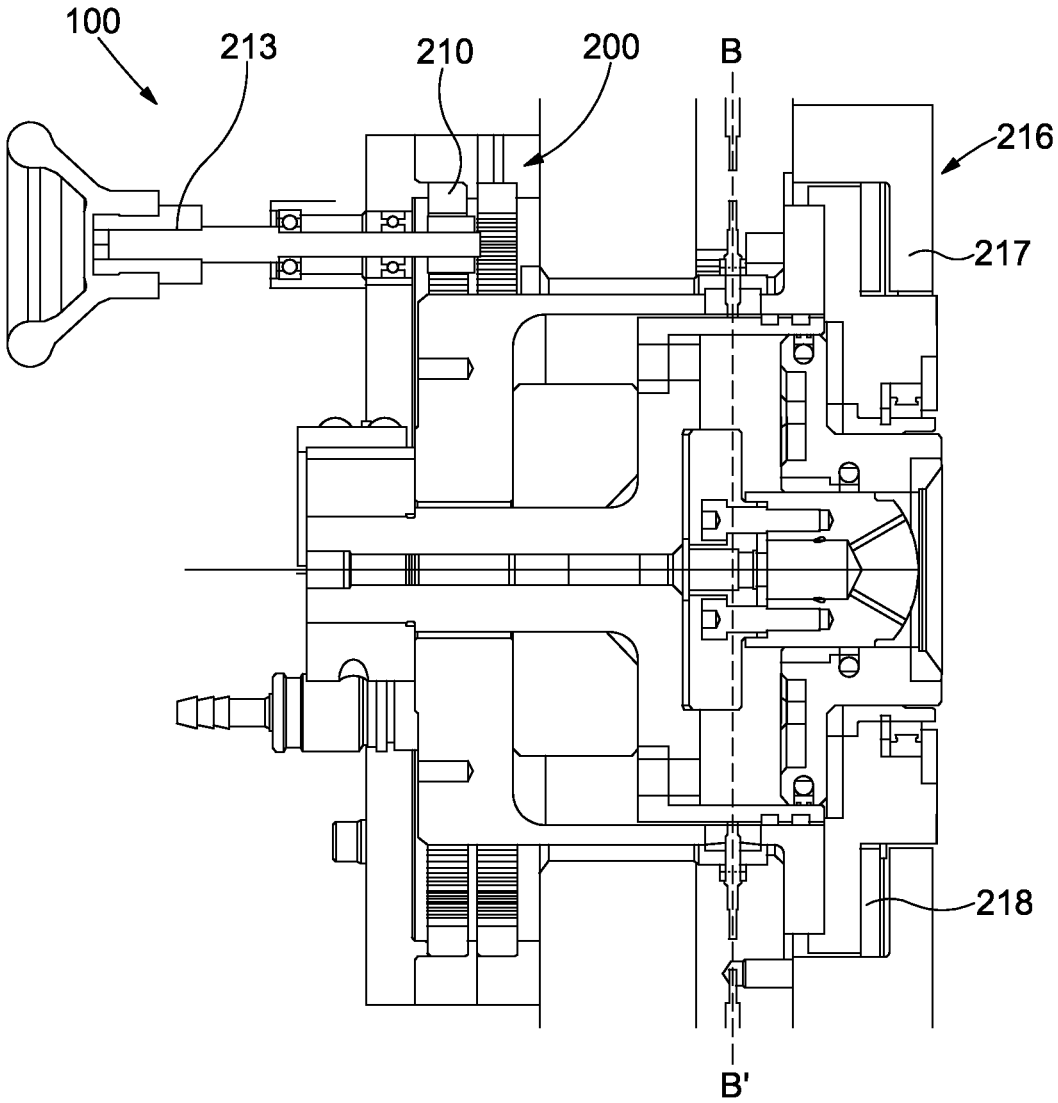
FIG. 6 is a schematic cross-sectional top view of the dome station of FIG. 3.

FIG. 4 shows a schematic cross-sectional side view of an adjustment mechanism 200 for aligning the housing 150 with respect to the punch. In this example, the adjustment mechanism 200 comprises two pairs of linear actuators 201A-B, 202A-B for moving the housing 150 in a plane perpendicular to the punch, e.g. in both a vertical and a horizontal direction. The orthogonal arrangement of the linear actuators 201A-B, 202A-B is most clearly appreciated from FIG. 5 which shows is a schematic cross-sectional face view of the dome station 100 taken along the line A-A'. Details of the alignment mechanism 200 are also shown in FIG. 6 which is a schematic cross-sectional top view of the dome station 100.

In this example, the linear actuators 201A-B and 202A-B are each provided by a wedge mechanism comprising a spur gear 203, a threaded shaft 205, a movable wedge 206, a fixed wedge 207 and a pair of jaws 208A-B. The spur gear 203 is fixed at one end of the threaded shaft 205 to allow the shaft to be rotated using the spur gear. The fixed wedge 207 is mounted within a recessed portion of the shaft 205 at the other end of the shaft 205 whilst allowing the shaft 205 to remain free to rotate within the fixed wedge 207. The movable wedge 206 is located on the shaft 205 between the spur gear 203 and the fixed wedge 207. A threaded portion 209 of the movable wedge 209 cooperates with the threaded shaft 205 so that when the shaft is turned, the movable wedge 206 moves towards the fixed wedge 207. The pair of jaws 208A-B comprises an inner jaw 208A and an outer jaw 208B arranged on either side of the shaft 205 with respect to the housing 150. The two wedges 206, 207 taper inwardly towards one another and each of the jaws has a tapered profile which matches the taper of each of the wedges. By moving the movable wedge 207 towards (away) from the fixed wedge 206, the jaws 208A-B slide on the wedges to increase (decrease) their separation.

The alignment mechanism 200 further comprises a pair of internal gears 210, 211 for vertical and horizontal adjustment of the housing 150 and a pair of handles 212, 213 (the second handle 213 is visible in FIG. 6) for separately rotating each pair of internal gears 210, 211.

The dome station 100 further comprises a body 214 with a cylindrical internal bore 215 in which the alignment mechanism 200 is housed. Each internal gear 210, 211 is approximately the same size as the internal bore 215 and comprises a steel ring with teeth disposed around its interior face. The internal gears 210, 211 are arranged one after the other along the axis of the bore 215. The pair of wedge mechanisms 201A,B are diametrically opposed within the internal bore 215 with the housing 150 held in compression between their respective inner jaws 208A. The spur gear 203 of each wedge mechanism 201A,B is meshed with the teeth of one of the internal gears 211 so that both wedge mechanisms are operated when the internal gear 211 is turned using the handle 212. Similarly, the wedge mechanisms 202A,B are operated simultaneously by turning the other internal gear 210 using handle 213. The wedge mechanisms 201A,B are provided with threads of opposite handedness, so that they are driven in opposite directions by the rotation of the internal gear 211 (210). This configuration allows the housing 150 to be smoothly translated by the pairs of linear actuators 201A-B, 202A-B within a two-dimensional plane by turning the two adjustment handles 212, 213.

Following adjustment, the housing 150 may be locked in position using a locking mechanism 216 attached to the front face of the dome station 150. In this example, the locking mechanism 216 comprises a fixed front plate 217, a rotatable locking ring 218 and four sets of disc springs 219A-D. The front plate is bolted to the body 214 of the dome station 100 to hold the locking ring 218 against the front plate 170 of the housing 150 (see FIGS. 4 and 6). The sets of disc springs 219A-D are arranged around the face of the front plate 217, with each set 219A-D comprising two springs for holding the locking ring 218 in compression against the housing 150.

Figure 7:
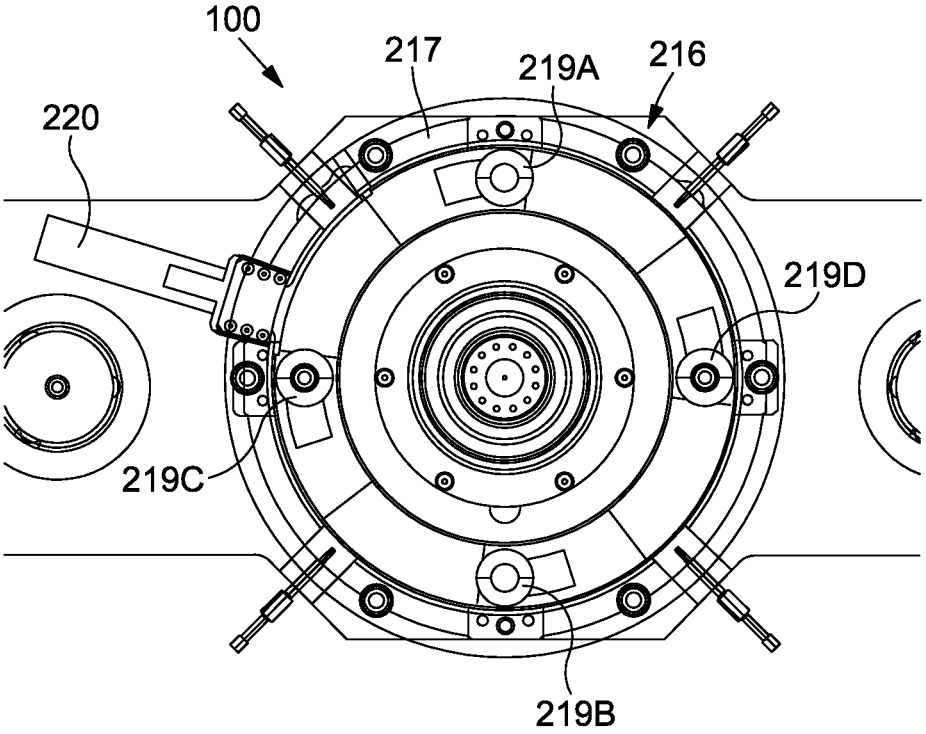
FIG. 7 is a schematic face view of the dome station of FIG. 3.

FIG. 7 shows a schematic end view of the dome station 100. The locking ring 218 is rotatable between locked and unlocked positions using a handle 220 attached to the outside edge of the ring. The locking ring 218 has a variable (tapered) thickness around its circumference so that when it is in the locked position thicker sections of the ring 218 are aligned with the sets of disc springs 219A-D. This arrangement causes the locking ring to exert a force to clamp the housing 150 against the body 214 of the dome station 100. In the unlocked position, thinner sections of the ring 218 are aligned with the sets of disc springs 219A-D, thereby reducing or removing the clamping force on the housing 150, thereby permitting adjustment of the housing position. Note that the floating cylinder 120 remains able to move relative to the housing 150 regardless of whether the locking mechanism 216 is locked or unlocked.

Figure 8:
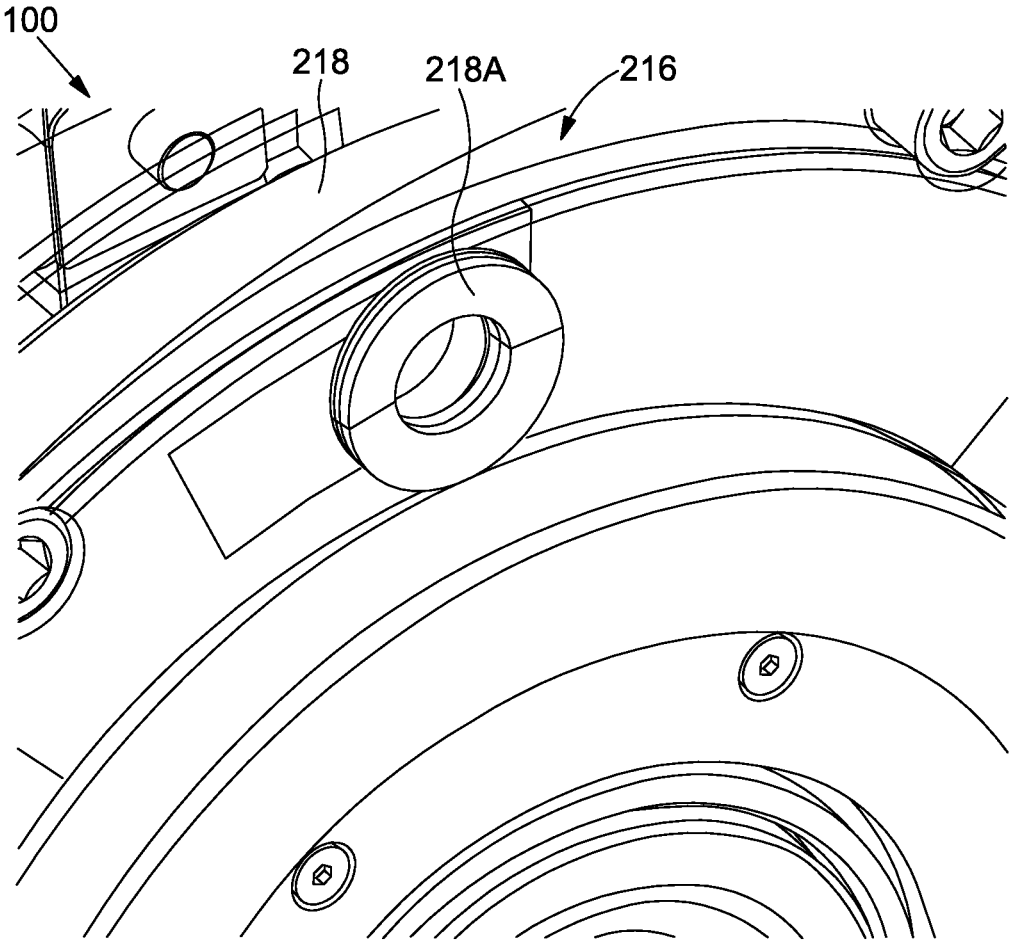
FIG. 8 is a schematic perspective view of the dome station of FIG. 3.

FIG. 8 is a schematic perspective view of the dome station 100 showing part of the locking mechanism 216. In this example, the locking ring 218 is in a position which is intermediate between the locked and unlocked positions: further clockwise rotation of the locking ring 218 would bring the tapered front surface of the ring into contact with the set of disc springs 219A. The rear surface of the ring 218 may be flat to ensure an even force is applied to the housing 150 when the locking mechanism 216 is locked.

Figure 9:
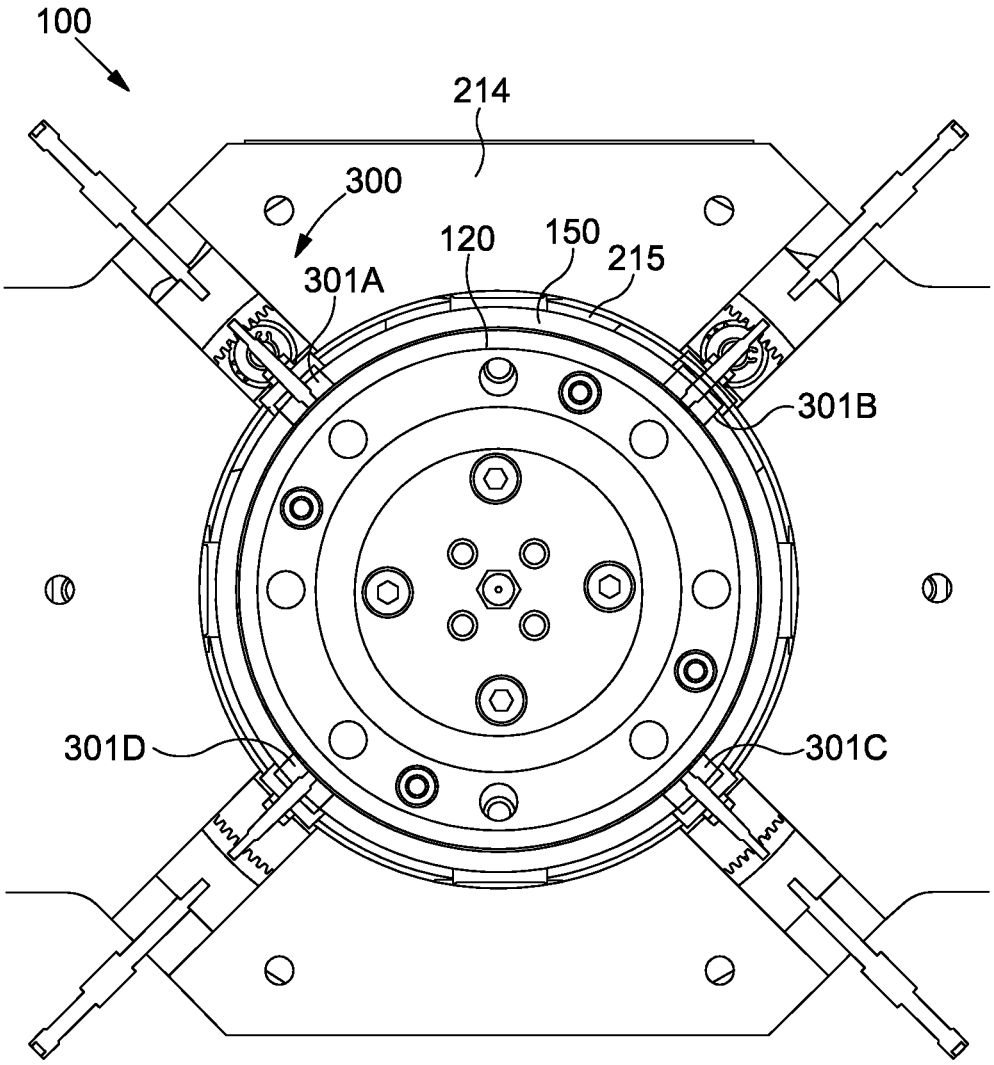
FIG. 9 is a schematic cross-sectional face view of the dome station of FIG. 3 taken along the line B-B' shown in FIG. 6.

FIG. 9 shows a schematic cross-sectional face view of the dome station 100 taken along the line B-B' shown in FIG. 6. The dome station 100 comprises an eddy current sensor system 300 to measure displacement of the floating cylinder 120 within the housing 150. In this example, the sensor system 300 comprises four eddy current sensors 301A-D mounted within channels extending through the body 214 and internal bore 215 of the dome station and into the housing 150 containing the floating cylinder 120. The sensors 301A-D are equally spaced around the body 214 and orientated to point towards the centre of the floating cylinder 120. The sensors 301A-D each output a voltage signal which depends on their distance from the floating cylinder 120, which must comprise a conductive material in order for the eddy current sensors to work. When the displacement of the floating cylinder 120 changes, e.g. after being hit by the punch, the voltages from the sensors 301A-D increase or decrease depending on the magnitude and direction of the displacement.

The eddy current sensors 301A-D are able to measure the position of the floating cylinder 120 with high sensitivity on account of its large surface area. The large diameter of the cylinder 120 (compared with the die 105, for example) also means that multiple sensors can be placed close to the cylinder 120 to obtain a more precise measurement. Furthermore, the high measuring frequency and accuracy of the sensors 301A-D allows for a high temporal and spatial resolution in the position measurements.

As the floating cylinder 120 is coupled to the die 105 and hold down ring 110, displacement of the cylinder 120 can be used to infer the position of these components and identify any misalignment with the punch. The sensor system 300 therefore provides information (e.g. live feedback) which can be used to help align the dome station 100 with respect to the punch, e.g. using the adjustment mechanism 200. This information may be advantageous in allowing operators of the can bodymaker with less skill and experience to perform the alignment.

The sensor system 300 may provide signals relating to the position of the floating cylinder to a processor, which may, for example, use the signal data to generate a report of the alignment of the die 105 and/or the hold down ring 110 with respect to the punch. An operator of the can bodymaker may use this report to monitor the alignment and performance of the machine, e.g. to assess and then correct drifts in the alignment over time or to identify wear or damage to the components of the can bodymaker. The processor may be connected to one or more display devices in order to display alignment information derived from the signals to the operator, e.g. using a graphical representation of the data such as the diagram shown in FIG. 10. The processor may also be connected to an alarm, such as a siren, to alert the operator to misalignments when they occur.

Previously recorded sensor data may be used to return the dome station 100 to a previous alignment, thereby speeding up the alignment process by, for example, removing or reducing the need for trial and error processes.

As it is the position of the floating cylinder 120 which is measured by the sensor system 300, rather than the positions of the die 105 and hold down ring 110 directly, it is possible to replace these components without needing to recalibrate the sensor system 300, e.g. the die 105 could be swapped for a smaller diameter die and the position of the floating cylinder 120 may remain unaffected.

The sensor system 300 also allows monitoring of the base forming process for quality control, safety monitoring and/or assessing the need to replace damaged or worn parts. For example, data collected from the sensor system 300 can be used to identify quality issues before they arise, such as in situations where the punch and dome station 100 are beginning to drift out of alignment.

Figure 10:
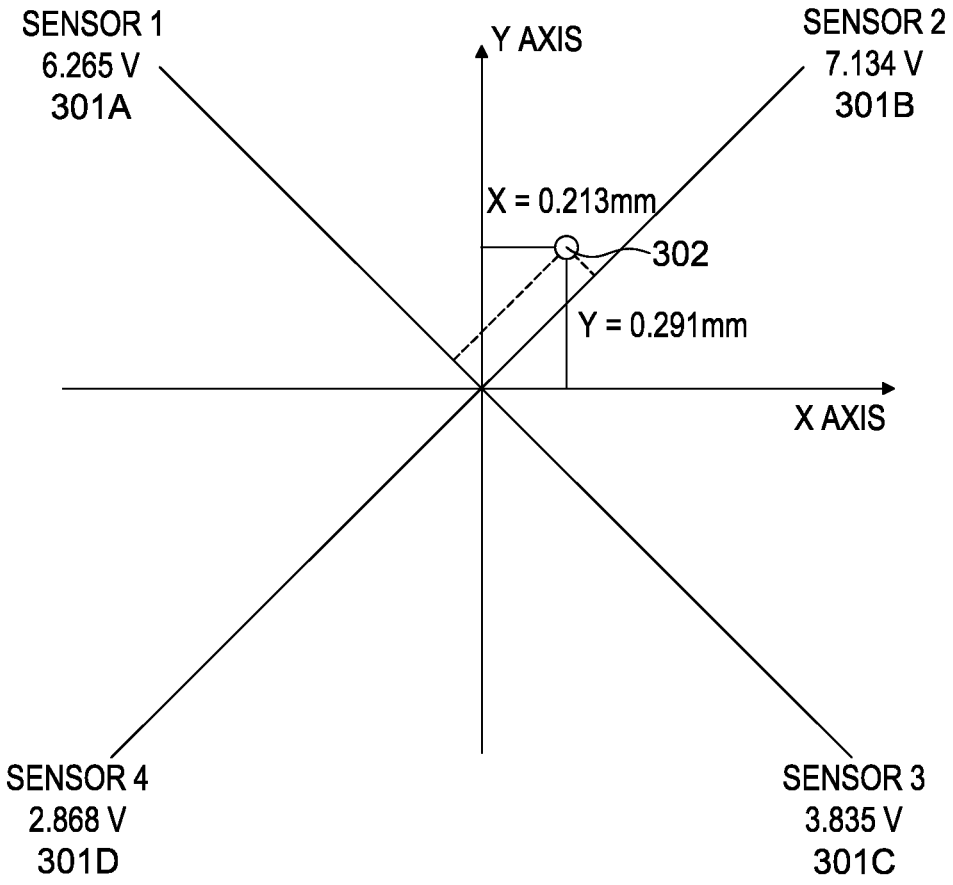
FIG. 10 is a diagram illustrating the use of a displacement measurement system for the dome station of FIG. 3.

FIG. 10 is a diagram showing how the voltage signals obtained from the eddy current sensors 301A-D are processed to obtain the displacement of the floating cylinder 120 with respect to a horizontal X-axis and a vertical Y-axis. The diagram shows a second pair of "voltage" axes which are oriented at 45° to the X and Y axes and which are aligned with the sensors 301A-D. In this example, the voltages measured by the sensors 301A-D are, respectively: 6.265 V, 7.134 V, 3.835 V and 2.868 V. The set of measurements is used to define a point 302 on the voltage axes, e.g. the distance of the point 302 along each voltage axis is determined according to the relative magnitude of the voltages obtained from the opposing pairs of sensors 301A-C, 301B-D. The position of the point 302 on the X and Y axes is then read off to obtain the displacement of the floating cylinder 120.

It will be appreciated by the person of skill in the art that various modifications may be made to the above described embodiments without departing from the scope of the invention. For example, although the sensor system has been described as measuring the position of the floating cylinder 120, in alternative arrangements the sensor system may be used to measure the position of the die 105 and/or hold down ring 110 directly, e.g. by co-locating or integrating the sensor system into the front plate 170 of the housing 150.

The invention claimed is:

1. An apparatus for forming a base profile on a metal container carried on a punch moving in an axial direction, the apparatus comprising:

a die shaped to form the base profile on the container;

a floating cylinder coupled to the die such that the die and the floating cylinder are substantially axially fixed together;

a hold down ring surrounding the die and slidable thereon against a restoring force applied in the axial direction, the hold down ring being positioned to contact a base of the container ahead of the die, the hold down ring being deflectable relative to the floating cylinder in the axial direction and positioned at least partially within the floating cylinder; and a resilient support positioned about the hold down ring, the resilient support being configured to hold the die in a resting position, wherein in the resting position a central axis of the die substantially aligns along a central axis of the apparatus in the axial direction, the resilient support being further configured to allow the die and the floating cylinder to be deflectable in a radial direction perpendicular to said axial direction and to provide a radial restoring force to return the die to the resting position.

2. The apparatus according to claim 1, wherein the die is deflectable perpendicular to said central axis of the apparatus by more than 100 μm.

3. The apparatus according to claim 1, wherein the hold down ring is deflectable perpendicular to said central axis of the apparatus in conjunction with the die.

4. The apparatus according to claim 1, further comprising one or more sensors for measuring deflection of the die perpendicular to said central axis of the apparatus.

5. The apparatus according to claim 1, further comprising one or more sensors for measuring deflection of the hold down ring perpendicular to said central axis of the apparatus.

6. The apparatus according to claim 4, wherein the one or more sensors are eddy current sensors.

7. The apparatus according to claim 6, further comprising a housing surrounding the die and deflectable in conjunction with the die perpendicular to said central axis of the apparatus, the one or more eddy current sensors being configured to measure deflection of the housing perpendicular to said central axis of the apparatus.

8. The apparatus according to claim 7, wherein the one or more eddy current sensors comprise four eddy current sensors spaced circumferentially about the central axis of the apparatus, each of the eddy current sensors being spaced equidistant from each of the other eddy current sensors.

9. A can bodymaker comprising the apparatus of claim 1.

10. A method for forming a base profile on a metal container, the method comprising:

locating a container on a punch, driving a container base by the punch, in an axial direction, against a die defining said base profile, wherein the die is axially fixed to a floating cylinder, and wherein a hold down ring surrounds the die and is slidable thereon, the hold down ring being positioned to contact the container base ahead of the die, the hold down ring being deflectable relative to the floating cylinder in the axial direction, wherein the die and the floating cylinder are deflectable perpendicular to said axial direction against a restoring force upon impact of the container base against the die or against the hold down ring.

11. The method according to claim 10, further comprising measuring the deflection of the die perpendicular to said axial direction by the punch.

* * * * *